United States Patent [19]

Longenecker

[11] 4,445,589

[45] May 1, 1984

[54] WINDOW ASSEMBLY INCLUDING A STORABLE FIRE ESCAPE

[76] Inventor: Bruce A. Longenecker, 4034 Newport Ave., Omaha, Nebr. 68112

[21] Appl. No.: 491,601

[22] Filed: May 4, 1983

[51] Int. Cl.[3] ..... E06C 9/14

[52] U.S. Cl. ..... 182/76; 182/77; 182/21; 182/129; 49/141

[58] Field of Search ..... 182/76, 77, 78, 81, 182/70, 21, 129; 49/141

[56] References Cited

U.S. PATENT DOCUMENTS

| | | | |
|---|---|---|---|
| 203,077 | 4/1878 | Shaw | 182/76 |
| 260,627 | 7/1882 | Townsend et al. | 182/76 |
| 412,630 | 10/1889 | Klipp | 182/76 |
| 1,397,643 | 11/1921 | Lyle | 182/76 |
| 2,709,030 | 5/1955 | Vroman | 182/76 |
| 4,237,654 | 12/1980 | Landem | 49/141 |
| 4,249,345 | 2/1981 | Littleton | 49/141 |

*Primary Examiner*—R. P. Machado
*Attorney, Agent, or Firm*—Zarley, McKee, Thomte, Voorhees & Sease

[57] ABSTRACT

A window assembly including a storable fire escape ladder is described including a first frame mounted in the wall of the building and having a window support frame positioned therein with the window support frame being pivotally connected at its upper end to the first frame to enable the support frame to be pivotally moved from a closed position outwardly to an escape or open position. The first frame includes a storage compartment at its lower end in which the fire escape ladder is stored. A panel member extends downwardly from the window in the window support frame and normally closes or covers the open outer end of the storage compartment when the window support frame is in its closed position.

5 Claims, 5 Drawing Figures

WINDOW ASSEMBLY INCLUDING A STORABLE FIRE ESCAPE

BACKGROUND OF THE INVENTION

This invention relates to a window assembly and more particularly to a window assembly having a storable fire escape ladder associated therewith.

The escape from a burning building is difficult especially in multiple story buildings. Chain-type fire escape ladders have been provided to enable a person to hang the ladder from upstairs window in an effort to facilitate the escape. A problem associated with the conventional fire escape ladders is that they must be stored near the window and the storage of the same detracts from the aesthetic appearance of the room in which the ladder is stored. A further problem associated with the conventional fire escape ladders of the chain type is the difficulty encountered in securing the upper end of the ladder to the window sill. Additionally, it is difficult to exit through the window due to the size restraints and due to the fact that there may be a screen on the window.

Therefore, it is a principal object of the invention to provide a window assembly unit including a storable fire escape ladder.

A further object of the invention is to provide a window assembly unit which may be pivotally moved outwardly from the building to facilitate escape from the building.

Still another object of the invention is to provide a window assembly unit including a storable fire escape ladder which is not visible when the window assembly in in its closed position.

Still another object of the invention is to provide a window assembly unit including a storable fire escape ladder wherein the upper end of the fire escape ladder is secured to the frame extending around the window assembly.

Still another object of the invention is to provide a window assembly unit which has aesthetic qualities.

Yet another object of the invention is to provide a window assembly unit which is economical of manufacture and durable in use.

These and other objects will be apparent to those skilled in the art.

SUMMARY OF THE INVENTION

A rectangular first frame or casement is provided in the side of the building into which the window assembly is mounted. The first frame includes a storage compartment at its lower end which has an open outer end. A window support frame or casement is pivotally mounted within the first frame and is pivotally movable from a closed position to an open or an escape position. The window support frame includes a panel at its lower end which normally closes the open outer end of the storage compartment so that the fire escape ladder is protected from the elements and so that the fire escape ladder is not visible from the outside of the building. A pair of cylinders are pivotally secured to and extend between the first frame and window support frame to urge the window support frame outwardly to the open position. When it is desired to escape from the building in which the window assembly is mounted, the window support frame is unlocked and outward force is exerted on the window support. The outward force applied to the window support frame and the cylinders cause the window support frame to pivotally move outwardly from the building to provide an escape exit. The person then reaches into the storage compartment and pulls the fire escape ladder outwardly therefrom and drops the same towards the ground.

DESCRIPTION OF THE PREFERRED EMBODIMENT

Figure 1:
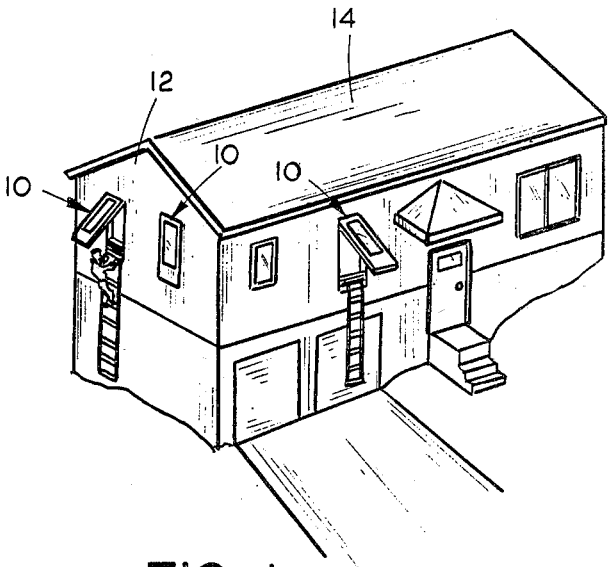
FIG. 1 is a perspective view of a building illustrating three of the window assemblies being mounted therein with a pair of the window assemblies being positioned in the escape or open position.

The window assembly of this invention is referred to generally by the reference numeral 10 and is designed to be mounted in the wall 12 of a building 14. FIG. 1 illustrates three of the window assemblies mounted therein with two of the window assemblies having been moved to the open position.

Window assembly 10 includes a first frame means or casement 16 which is mounted in the wall 12 in the same manner in which conventional window assemblies are mounted in walls. For example, the frame means 16 would be positioned between wall studs and would have conventional headers and the like associated therewith.

Figure 5:
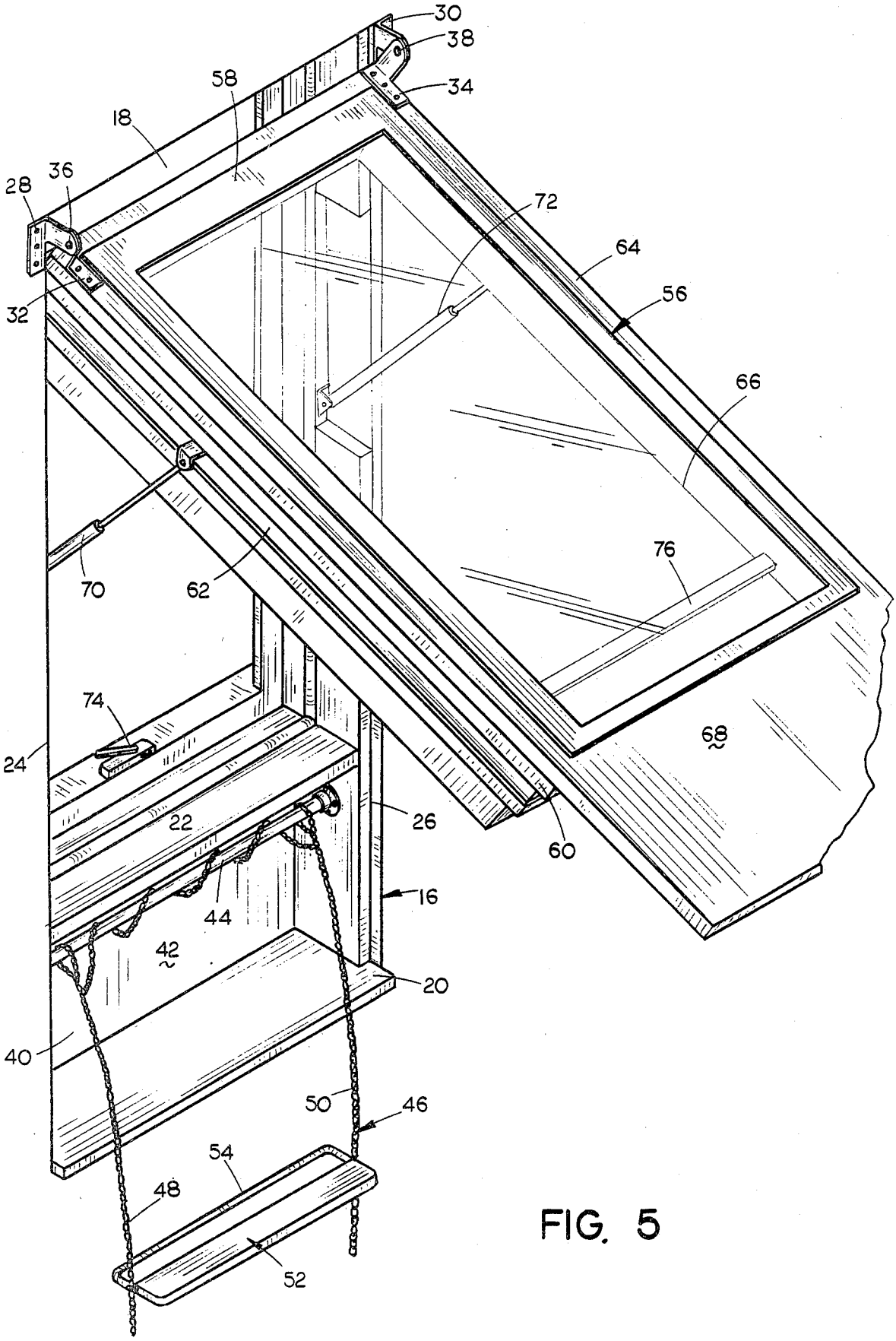
FIG. 5 is a perspective view illustrating the window in the open position.

Frame means 16 includes an upper frame member 18, lower frame member 20, intermediate frame member 22, and opposite side frame members 24 and 26. A pair of brackets 28 and 30 are secured to the first frame 16 as illustrated in FIG. 5 and extend outwardly therefrom. Brackets 32 and 34 are pivotally connected thereto about pivot points 36 and 38 respectively.

Figure 3:
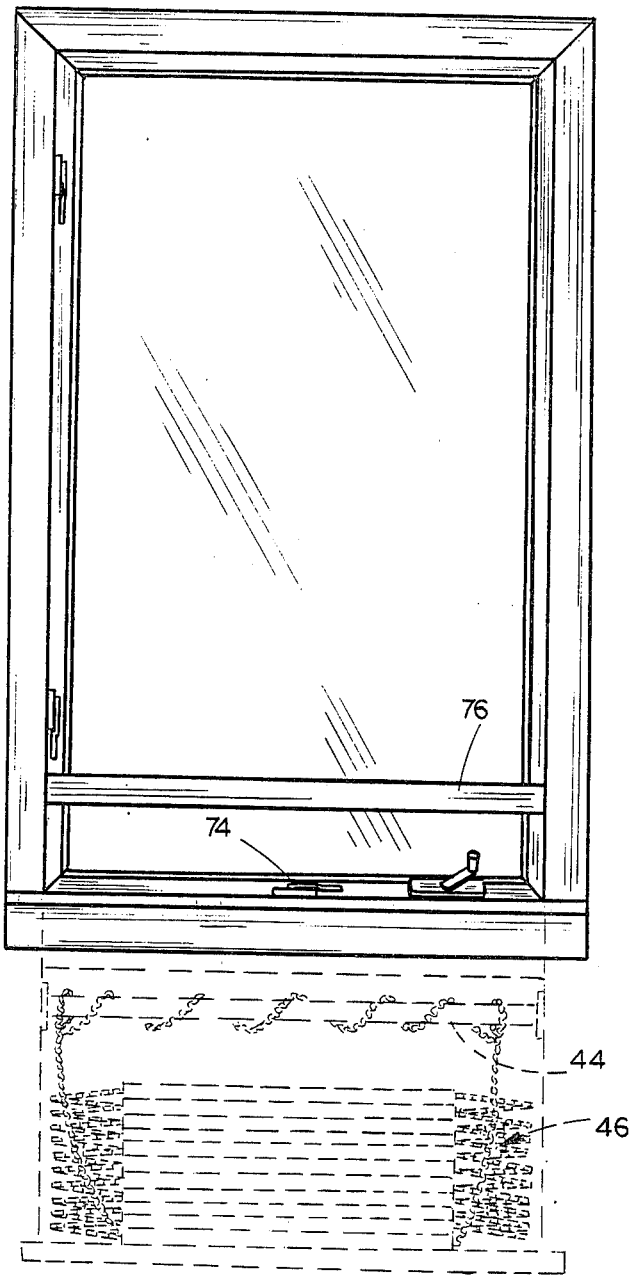
FIG. 3 is an inside view of the window assembly of this invention with the broken lines indicating the fire escape ladder in the stored position.
Figure 4:
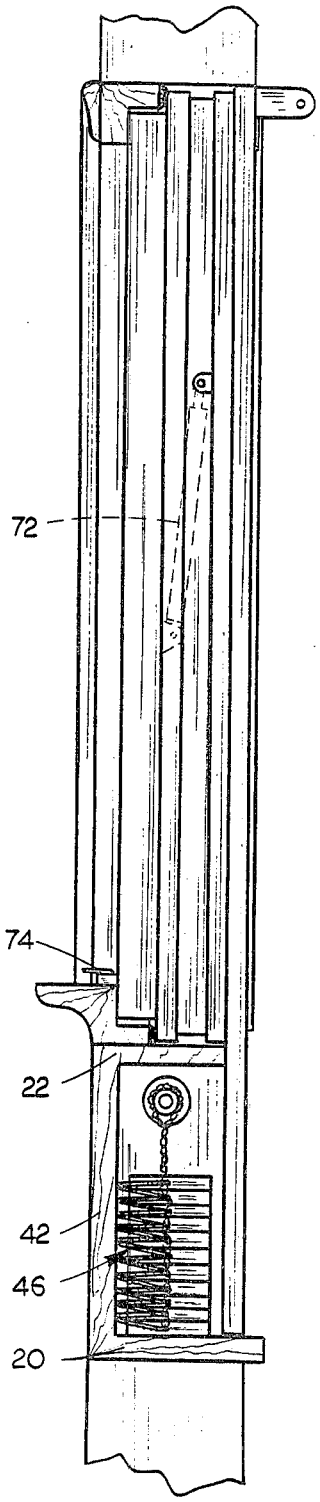
FIG. 4 is a view similar to FIG. 2 except that the window is in the closed position.

Frame means 16 is provided with a storage compartment 40 formed therein at its lower end which is defined by lower frame member 20, intermediate frame member 22, side frame members 24 and 26. If desired, the frame means 16 may also be provided with a wall portion 42 which extends between the inner ends of frame members 20 and 22 as illustrated in FIG. 4. However, wall member 42 is not essential since the wall member 42 could be formed by the outside surface of the wall board in the building. Pipe 44 is mounted in the storage compartment 40 and has its opposite ends secured to the frame members 24 and 26. The numeral 46 refers to a storable fire escape ladder which is normally stored within the storage compartment 40 as illustrated in FIGS. 3 and 4. Fire escape ladder 46 comprises a pair of chains 48 and 50 having their upper ends secured to the pipe 44. A plurality of spaced-apart steps or rungs 52 are secured to the chains 48 and 50 as illustrated in the drawings. As seen in the drawings, each of the steps 52 is provided with an inner end 54 which is adapted to engage the side of the building so that the outer end of the step is positioned outwardly from the building to enable a person to have ample surface upon which to step during an escape.

Window support frame means or casement 56 is pivotally mounted within the frame means 16 as seen in the drawings. The brackets 32 and 34 are secured to the upper outer surface of the frame means 56 so that the frame means 56 may be pivotally moved from the closed position of FIG. 4 to the open position of FIGS. 2 and 5. For purposes of description, frame means 56 will be described as having an upper frame portion 58, lower frame portion 60, opposite side frame portions 62 and 64, and window 66. The lower end of window 66 terminates above frame member 22 of frame means 16 as illustrated in the drawings. Frame means 56 includes a panel 68 which extends downwardly from the window 66 to close the open outer end of the storage compartment 40 when the window assembly is in the closed position. Panel 68 not only protects the fire escape ladder from the elements but also provides an attractive appearance to the outside portion of the window. A pair of hydraulic or spring-loaded cylinders 70 and 72 are pivotally secured to and extend between the frame means 16 and the frame means 56 as seen in the drawings to normally urge the frame means 56 to the open position. The numeral 74 refers to a locking device for locking the window in the closed position.

Figure 2:
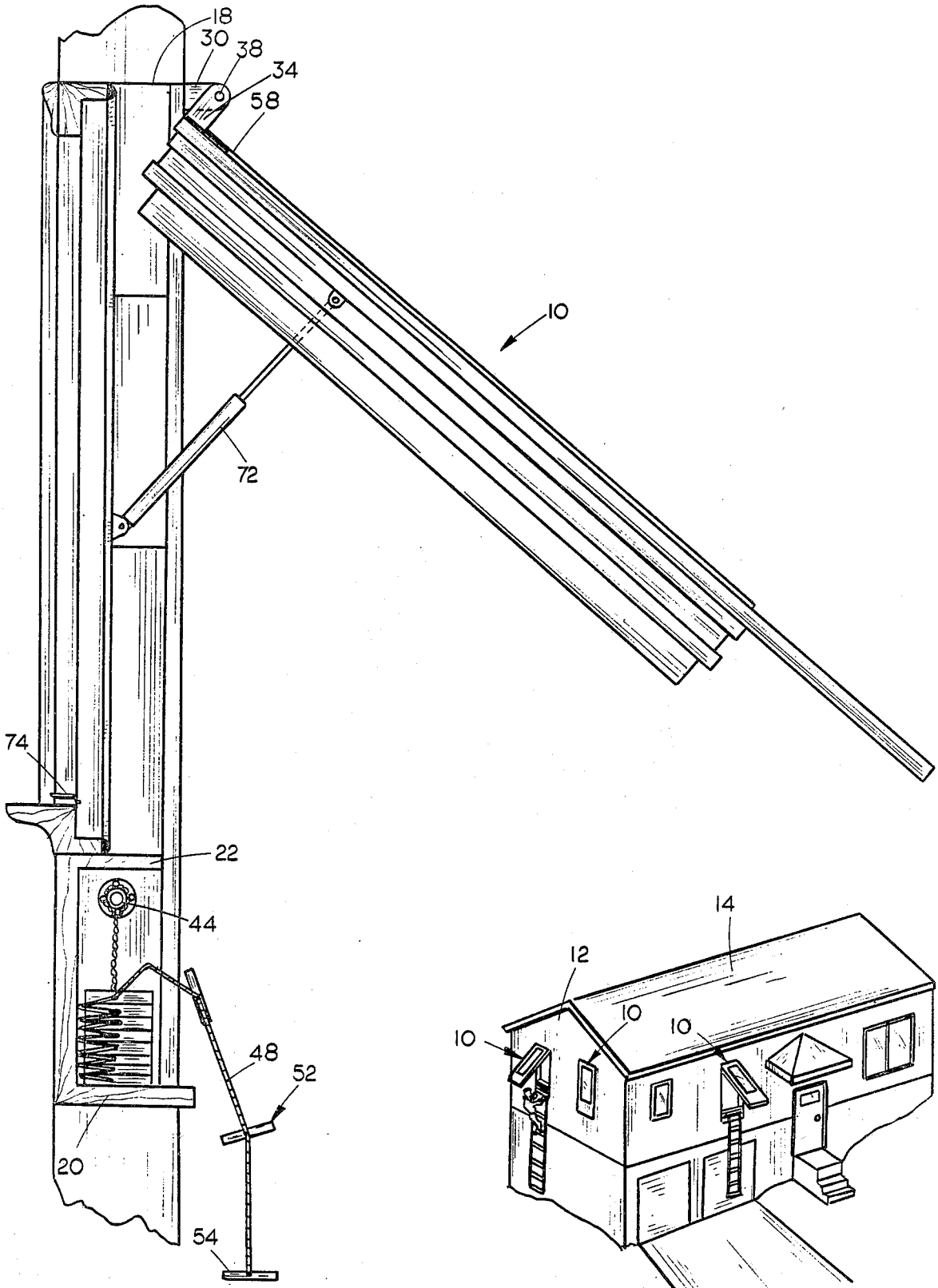
FIG. 2 is a side view of the window assembly of this invention in the open or escape position.

The window assembly is normally in the closed position of FIGS. 3 and 4 with the fire escape ladder being folded or stored within the storage compartment 42. When it is necessary to escape from the building, locking device 74 is released and outward force is applied to the push bar 76 which extends across the lower end of the frame means 56. The outward force applied to the push bar 76 and the cylinders 70 and 72 cause the frame means 56 to be pivotally moved outwardly from the closed position of FIG. 4 to the open position of FIGS. 2 and 5. The person desiring to escape simply reaches through the open window and grasps the escape ladder 46 in the storage compartment 42 and drops the same towards the ground as illustrated in FIGS. 1, 2 and 5. The person can then exit through the open window area and utilize the ladder 52 to escape from the building.

The window assembly of this invention offers several advantages over the prior art devices. The fact that the frame means 56 can be pivotally moved to the open position with relative ease is quite important. It is also important that a large escape area is provided so that a person may make a hasty exit therethrough and does not have to concern himself with the removal of screens, etc. The escape ladder is conveniently stored and is not visible from either the interior or exterior of the building so that the aesthetic qualities of the building are not altered. The fire escape ladder is positively secured to the frame means and will not become disengaged therefrom as is the possible case of other types of fire escape ladders.

Although frame means 56 is preferably pivoted to frame means 16 as shown in the drawings, the frame means 56 could be pivoted to the frame means 16 about a horizontal axis so that frame means 56 swings open to the side rather than upwardly.

Thus, it can be seen that a novel window assembly has been provided which accomplishes at least all of its stated objectives.

I claim:

1. In combination with a building including an outside wall, comprising, a vertically disposed rectangular first frame means mounted in the wall of the building including upper intermediate, lower and opposite side frame portions, said intermediate, lower and side frame members defining a storage compartment therebetween having an open outer end, a vertically disposed window support frame means positioned within said first frame means including upper, lower and opposite side frame portions, said window support frame means being pivotally secured to said first frame means whereby said window support frame means may be pivotally moved outwardly relative to the building wall and said first frame means, said window support frame means being pivotally movable between closed and escape positions relative to said building wall and said first frame means, a window means mounted in said window support frame means, a panel means provided on said window support frame means extending downwardly from the lower end of said window means which covers the open outer end of said storage compartment when said window support frame means is in its closed position, a foldable escape ladder stored within said storage compartment which may be lowered towards the ground when said window support frame means is moved to its escape position, and releasable locking means normally maintaining said window support frame means in its closed position.

2. The combination of claim 1 wherein a pivotal resilient means is secured to and extends between said window, support frame means and said first frame means for urging said window support frame means to its escape position.

3. The combination of claim 1 wherein said escape ladder comprises a pair of chains having rungs secured thereto and extending therebetween.

4. The combination of claim 3 wherein a pipe means is secured to and extends between said side frame members of said window support frame means within said storage compartment, said chains being secured to said pipe means.

5. The combination of claim 1 wherein said window support frame means is pivotally secured, about a horizontal axis adjacent its upper end, to said first frame means.

* * * * *